US007112163B2

(12) United States Patent
Krull

(10) Patent No.: US 7,112,163 B2
(45) Date of Patent: Sep. 26, 2006

(54) STANDS FOR SUPPORTING EXERCISE DUMBBELLS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 498 days.

(21) Appl. No.: 10/345,428

(22) Filed: Jan. 15, 2003

(65) Prior Publication Data

US 2004/0138031 A1 Jul. 15, 2004

(51) Int. Cl.
*A63B 21/078* (2006.01)

(52) U.S. Cl. ..... 482/104; 482/106; D21/681

(58) Field of Classification Search ..... 482/104–108; D21/675, 680, 681
See application file for complete search history.

(56) References Cited

U.S. PATENT DOCUMENTS 645,127 A * 3/1900 Koeing ..... 324/114
4,477,074 A * 10/1984 Bushnell ..... 482/108
5,472,397 A 12/1995 Ammoscato et al. ..... 482/104
5,630,776 A 5/1997 Yang ..... 482/104
5,924,964 A 7/1999 Hayden ..... 482/104
5,954,619 A * 9/1999 Petrone ..... 482/104
D441,813 S * 5/2001 Ceppo ..... D21/686
6,682,464 B1 * 1/2004 Shifferaw ..... 482/106

* cited by examiner

*Primary Examiner*—Lori Amerson

(57) ABSTRACT

An exercise system includes a unique dumbbell stand configured to support first and second dumbbells in more than one configuration. The dumbbells are preferably mounted on respective floor engaging frame members that are movable relative to one another. The stand is preferably provided with rollers to facilitate rolling across a floor surface, and an accessory tray with compartments to hold personal items for a user.

39 Claims, 7 Drawing Sheets

STANDS FOR SUPPORTING EXERCISE DUMBBELLS

FIELD OF THE INVENTION

The subject invention relates to exercise methods and apparatus, and more specifically, to dumbbell stands and dumbbell stands combined with dumbbells to provide exercise systems.

BACKGROUND OF THE INVENTION

Various types of exercise equipment are known in the art. One popular form of equipment is the exercise dumbbell, which is typically designed with one or more weights disposed at each end of a handle. Relatively more advanced dumbbell systems provide a plurality of weights in alignment with the handle for selective connection to the handle. Examples of such systems are disclosed in U.S. Pat. No. 4,822,034 to Shields; U.S. Pat. No. 4,284,463 to Shields; U.S. Pat. No. 5,637,064 to Olson et al.; U.S. Pat. No. 5,769,762 to Towley, III et al.; and U.S. Pat. No. 5,839,997 to Roth et al. An object of the present invention is to provide methods and apparatus for supporting exercise dumbbells in user friendly fashion, and/or supporting selectorized dumbbell weight plates that remain behind when the handles are lifted.

SUMMARY OF THE INVENTION

The present invention provides methods and apparatus for providing support for dumbbells. For example, the present invention may be described in terms of a dumbbell stand for supporting a pair of exercise dumbbells above a floor surface, comprising first and second dumbbell supports, each having a leg portion configured and arranged to engage the floor surface, and a beam portion configured and arranged to support a respective dumbbell. The dumbbell supports are interconnected for relative pivoting about at least one vertical axis to define a first configuration, wherein a first horizontal distance is defined between the leg portions, and to alternatively define a second configuration, wherein a second, relatively greater horizontal distance is defined between the leg portions.

The present invention may also be described in terms of a dumbbell stand for supporting a pair of exercise dumbbells above a floor surface, comprising a first dumbbell support configured and arranged to support a first dumbbell; a second dumbbell support configured and arranged to support a second dumbbell; a base configured and arranged to engage the floor surface; an accessory tray mounted on the base; and a connecting means for connecting each said dumbbell support to the base in a manner that accommodates user adjustment of a distance defined between opposing counterparts on the first dumbbell support and the second dumbbell support. The dumbbell supports occupy a space directly forward of the tray when a first distance is defined between the opposing counterparts, and the space is available to accommodate a standing person when a relatively greater, second distance is defined between the opposing counterparts.

The present invention may also be described in terms of a dumbbell stand for supporting a pair of exercise dumbbells above a floor surface, comprising first and second dumbbell supports, each having a leg portion configured and arranged to engage the floor surface, and a beam portion configured and arranged to support a respective dumbbell; a base configured and arranged to engage the floor surface; and a connecting means for connecting each said dumbbell support to the base in a manner that accommodates arcuate movement across the floor surface of at least one said leg portion relative to the base.

The present invention may also be described in terms of a dumbbell stand for supporting a pair of exercise dumbbells above a floor surface, comprising a base having opposite end portions configured and arranged to engage the floor surface; first and second dumbbell supports, each having a leg portion configured and arranged to engage the floor surface, and a beam portion configured and arranged to support a respective dumbbell, and movably connected to the base.

The stands may be provided with floor engaging rollers to facilitate rolling across an underlying floor surface. Also, certain features of the different embodiments may be mixed, matched, and/or applied to other embodiments. For example, various accessory trays may be used on various stands to provide upwardly opening compartments for holding items along the lines of a beverage container, jewelry, keys, a note pad, and/or a remote control device for radio, television, and the like.

In a preferred application, the stand is configured to support first and second selectorized dumbbell assemblies, each of which includes (a) a handle that defines a longitudinal axis; (b) a set of weights configured for connection to a respective said handle; and (c) a base that is sized and configured to support a respective said set of weights in alignment with a respective said handle. Each such base is mounted on a respective dumbbell support. Various features and/or advantages of the present invention may become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
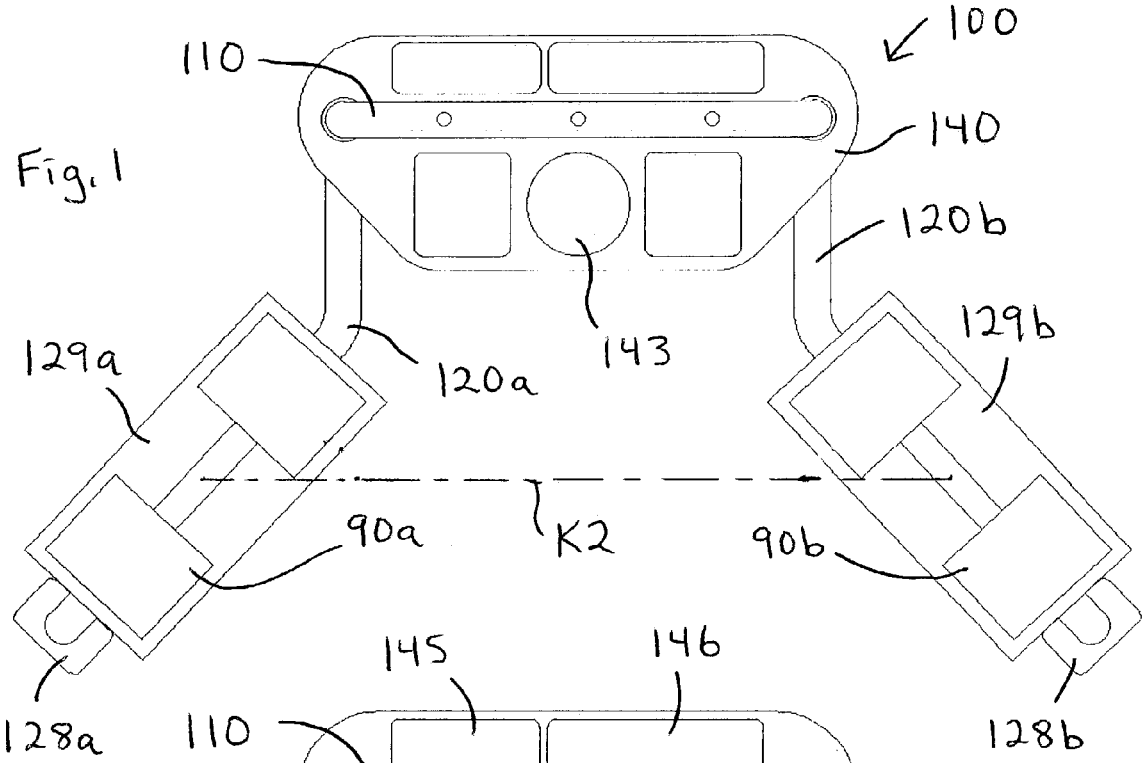
FIG. 1 is a top view of a first exercise system constructed according to the principles of the present invention, and arranged in a first configuration.

A first exercise system constructed according to the principles of the present invention is designated as 100 in FIGS. 1–5. The system 100 may be described in terms of a pair of known selectorized dumbbells 90*a* and 90*b* disposed on a novel dumbbell stand.

The dumbbells 90*a* and 90*b* are shown somewhat diagrammatically because their particular construction and operation are already known in the art, and are not critical to understanding the present invention. For purposes of this disclosure, the dumbbells 90*a* and 90*b* should be considered identical to those disclosed in U.S. Pat. No. 5,839,997 to Roth et al. (which is incorporated herein by reference), with the understanding that the present invention is not limited to this particular dumbbell or type of dumbbell.

Generally speaking, each dumbbell 90*a* and 90*b* includes a handle member and a plurality of weight plates that are selectively connected to a respective handle member. A weight base or cradle 129*a* and 129*b* is provided for each dumbbell 90*a* and 90*b* to support the weight plates in proper alignment when not in use. Each cradle 129*a* and 129*b* is approximately twelve inches long and six inches wide. The cradles 129*a* and 129*b* are similar to those disclosed in the Roth et al. patent, except to the extent that they have been modified for mounting on respective first and second dumbbell supports 120*a* and 120*b*. In this regard, each cradle 129*a* and 129*b* is preferably provided with a partially cylindrical channel that registers with a respective dumbbell support 120*a* or 120*b*, and is fastened in place by bolts (not shown) or other suitable means.

Each dumbbell support 120*a* and 120*b* may be alternatively described as a generally L-shaped member having a vertically extending leg portion that is supported by an underlying floor surface, and a horizontally extending beam portion that supports a respective dumbbell 90*a* or 90*b*, and is connected (by suitable connecting means) to a respective side of an intermediate frame member or support frame 110. Each leg portion terminates in a lower distal end, to which a respective caster-type roller 128*a* and 128*b* is preferably rotatably mounted. Each beam portion terminates in a distal end that is rigidly connected to a respective sleeve 121*a* or 121*b* by welding or other suitable means. The dumbbell supports 120*a* and 120*b* are preferably configured and arranged to position the handles of the dumbbells 90*a* and 90*b* at approximately table height above the floor.

The intermediate frame member 110 may be described as an inverted U-shaped member having first and second downwardly extending legs or shafts. Caster-type rollers 118*a* and 118*b* are rotatably mounted on the lower distal ends of respective legs. Each sleeve 121*a* and 121*b* is rotatably mounted on a respective leg of the intermediate frame member 110 for rotation about a respective vertical axis. On the depicted embodiment 100, respective lower collars 111*a* and 111*b* and upper collars 112*a* and 112*b* are secured to the respective legs of the intermediate frame member 110 (by set screws or other suitable means) to prevent translational movement of the sleeves 121*a* and 121*b*. The collars are also preferably configured to function as bushings between the legs of the intermediate frame member 110 and the sleeves 121*a* and 121*b*. The collars may also be provided with radially extending flanges to facilitate biasing and/or latching of respective beams portions relative thereto.

A tray 140 is mounted on the intermediate frame member 110 to provide upwardly opening compartments for storage of personal items. For example, the depicted tray 140 provides a cylindrical compartment 143 to support a typical beverage container; shallow square compartments 144*a* and 144*b* to store jewelry, a note pad, or other suitably sized items; a relatively deeper first compartment 145 to store a hand-held remote control device, a folded magazine, or other suitably sized items; and a relatively deeper second compartment 146 to store a portable CD player, one end of a towel, or other suitably sized items. On the depicted embodiment 100, the tray 140 slides onto the legs of the intermediate frame member 110 (before the sleeves 121*a* and 121*b*) and is bolted to the transverse portion of the intermediate frame member 110. In the alternative, a relatively smaller tray could simply be suspended from a central portion of the transverse portion or horizontal cross-bar.

Figure 4:
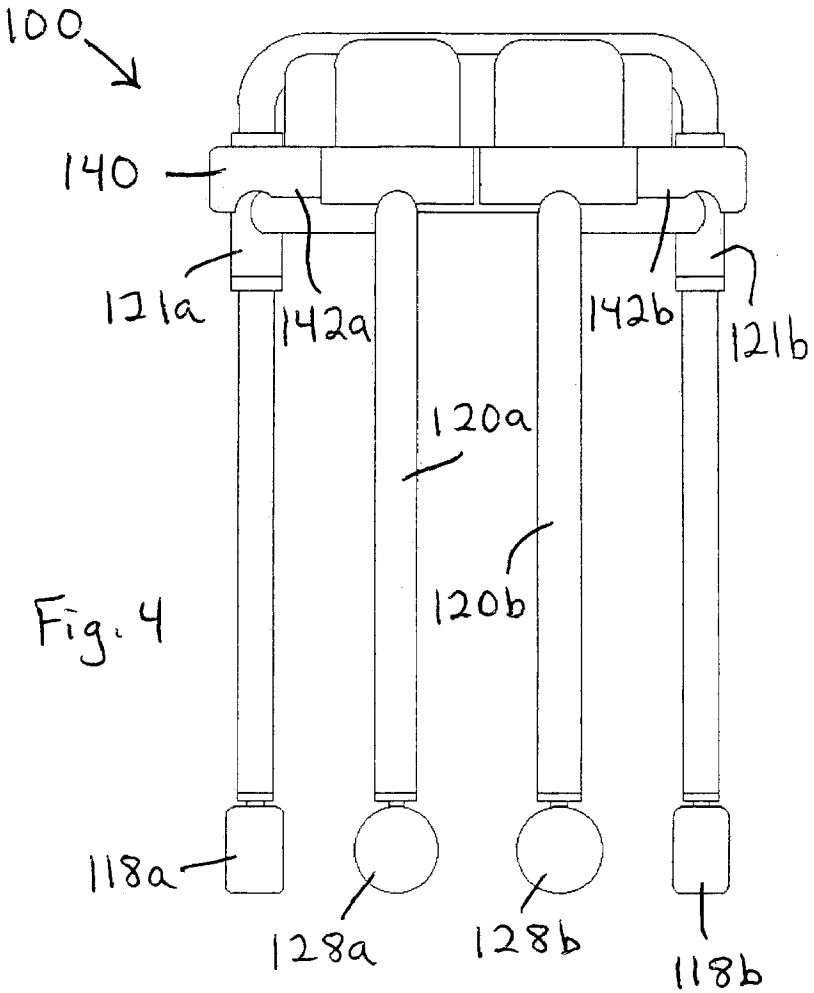
FIG. 4 is a front view of the exercise system of FIG. 2.
Figure 3:
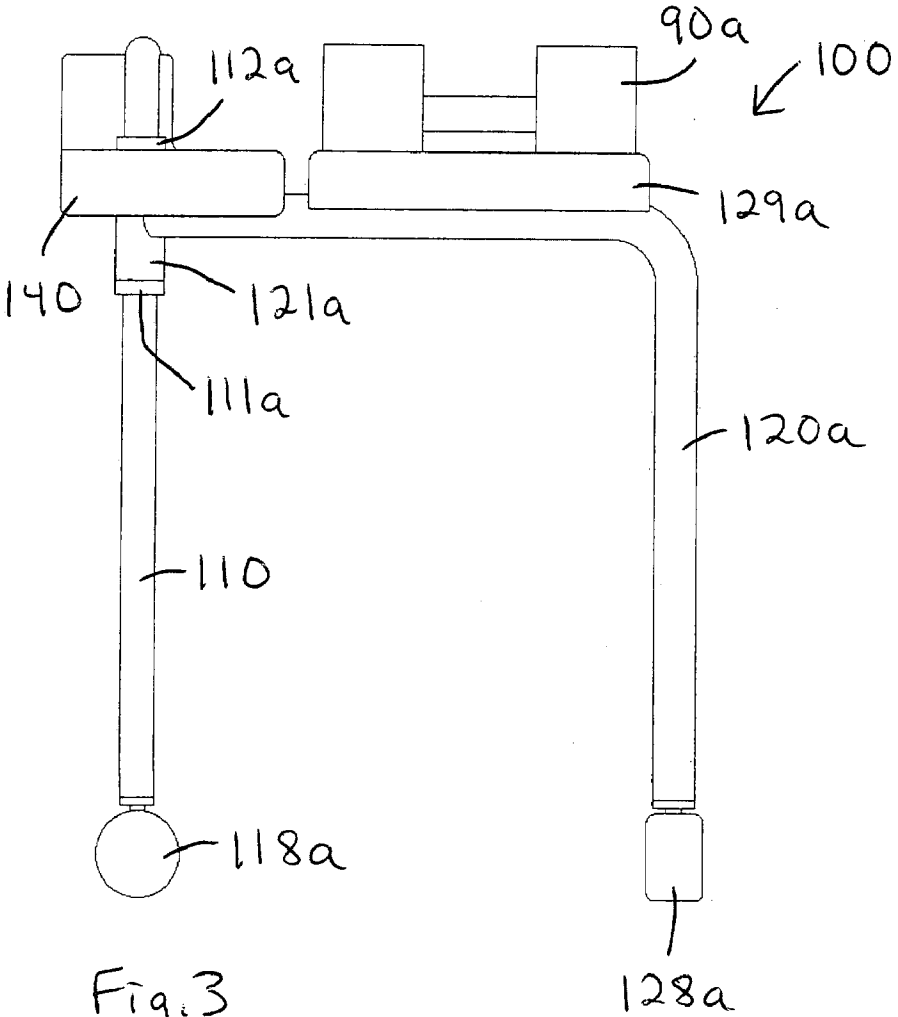
FIG. 3 is a side view of the exercise system of FIG. 2.

The tray 140 also may be configured to provide stops and/or means for latching the dumbbell supports 120*a* and 120*b* in prescribed orientations. For example, FIG. 4 shows downwardly extending tabs 142*a* and 142*b* on respective sides of the tray 140. In FIG. 4, the dumbbell supports 120*a* and 120*b* are disposed "inward" of respective tabs 142*a* and 142*b*, and the adjacent arcuate notches in the tray 140 define the respective "outward" ends of the tabs 142*a* and 142*b*. In FIG. 1, the dumbbell supports 120*a* and 120*b* are disposed "outward" of respective tabs 142*a* and 142*b*. The tabs 142*a* and 142*b* resiliently deflect to accommodate movement of the dumbbell supports 120*a* and 120*b* between these two configurations.

Those skilled in the art will recognize that the stand shown in FIGS. 1–5 may be constructed without the tray 140 and/or without the associated latching means. For example, in the absence of tray 140, the dumbbell supports 120*a* and 120*b* could be left free to pivot subject to frictional resistance, or spring detents could be imposed between the support frame 110 and the supports 120*a* and 120*b* to establish latched positions. Also, in the absence of tray 140, a water bottle holder could be mounted on any of the frame members 110, 120*a*, or 120*b*, and/or the transverse portion of the intermediate frame member 110 could serve as a towel bar.

Figure 2:
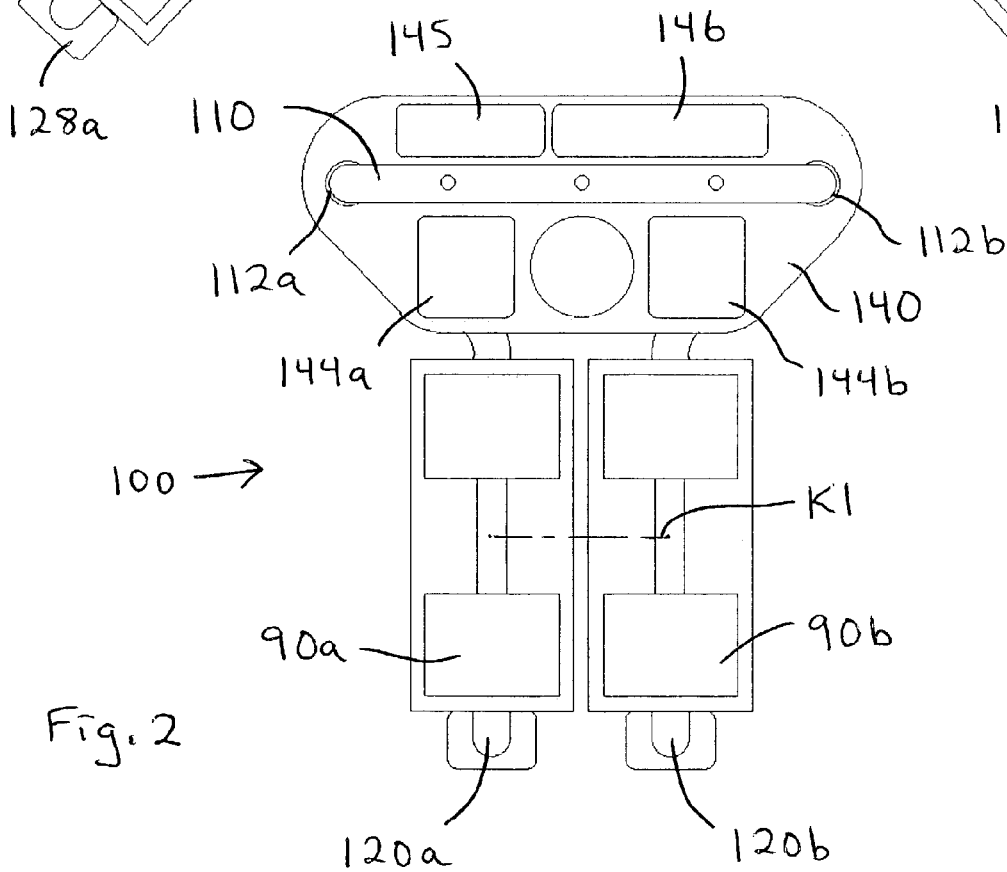
FIG. 2 is a top view of the exercise system of FIG. 1 arranged in a second configuration.

As suggested by FIGS. 1–2 and 5–6, the stand (with or without the tray 140) may be rearranged or transformed into multiple configurations. FIG. 2 shows a first, relatively compact configuration, wherein the dumbbell supporting portions of the supports 120*a* and 120*b* extend parallel to one another, and the dumbbells 90*a* and 90*b* are adjacent one another (with a distance K1 defined between their geometric centers). FIG. 1 shows a second configuration, wherein the dumbbell supporting portions of the supports 120*a* and 120*b* cooperate to define a V-shaped arrangement, and a person may stand directly in front of an edge of the tray 140 and between the dumbbells 90*a* and 90*b* (because a relatively greater distance K2 is now defined between their geometric centers). Generally speaking, the dumbbell supports 120*a* and 120*b* are configured (with an intermediate bend that defines an angled, V-shaped configuration when viewed from above) and arranged (at opposite sides of the intermediate frame member 110) so that the distance K1 is about six inches, and the distance K2 is about twenty inches. An even greater distance is defined between the rollers 128*a* and 128*b* on the leg portions of the dumbbell supports 120*a* and 120*b* in FIG. 1.

Figure 5:
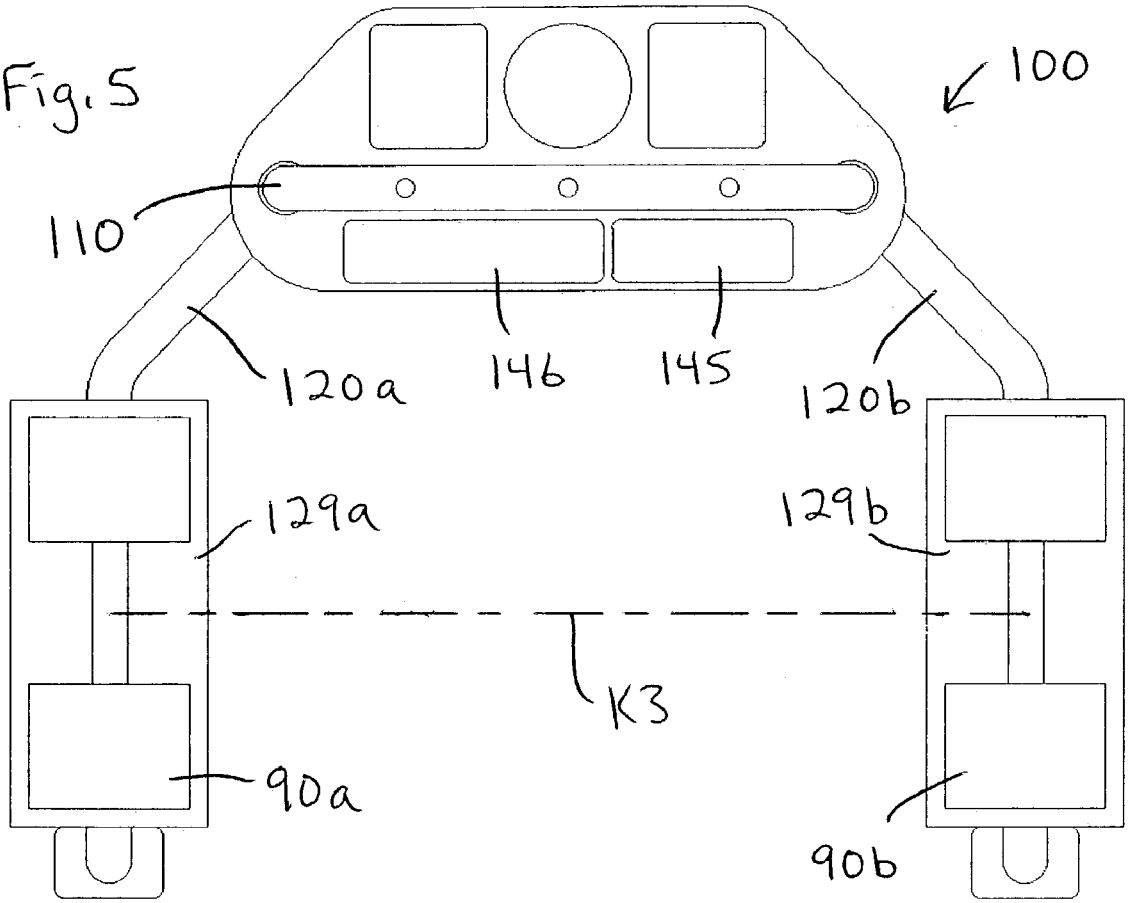
FIG. 5 is a top view of the exercise system of FIG. 1 arranged in a third configuration.
Figure 6:
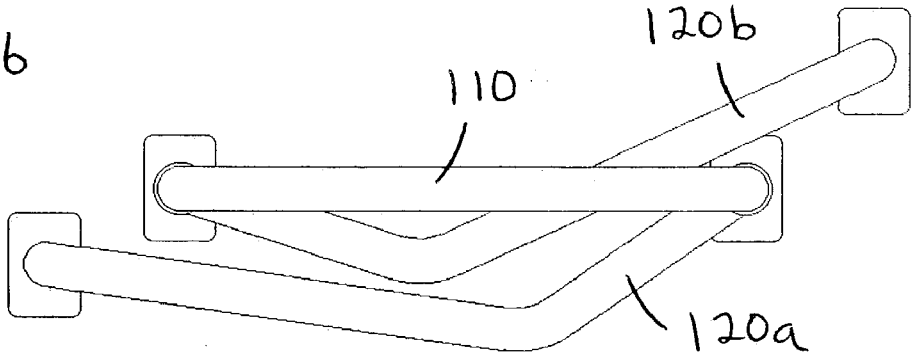
FIG. 6 is a top view of a stand portion of the exercise system of FIGS. 1–5 arranged in a fourth configuration.

FIG. 5 shows a third configuration, wherein the dumbbell supports 120*a* and 120*b* have been rotated 180 degrees as compared to FIG. 2, leaving even more space for a person to stand therebetween and directly in front of an opposite edge of the tray 140 (because an even greater distance K3, or about twenty-four inches, is now defined between the geometric centers of the dumbbells 90*a* and 90*b*). FIG. 6 shows the stand without the tray 140 or the cradles 129*a* and 129*b* attached thereto, allowing the dumbbell supports 120*a* and 120*b* to be rotated to a relatively compact configuration relative to the intermediate frame member 110 (for shipping and/or long-term storage).

A second exercise system constructed according to the principles of the present invention is designated as 200 in FIGS. 7–10. The system 200 may similarly be described in terms of the same pair of known selectorized dumbbells 90*a* and 90*b* disposed on another novel dumbbell stand.

A functionally identical weight base or cradle 229*a* and 229*b* is provided for each dumbbell 90*a* and 90*b* to support the weight plates in proper alignment when not in use. The cradles 229*a* and 229*b* are mounted on respective first and second dumbbell supports 220*a* and 220*b* by bolts (not shown) or other suitable means. The bottom of each cradle 229*a* and 229*b* is preferably provided with a partially cylindrical channel that registers with a respective dumbbell support 220*a* or 220*b*.

Each dumbbell support 220*a* and 220*b* may be alternatively described as a generally U-shaped member having a vertical leg portion that is supported by an underlying floor surface, an intermediate beam portion that extends horizontally and supports a respective dumbbell 90*a* or 90*b*, and another vertical leg portion that is rotatably connected to a respective intermediate frame member 210*a* or 210*b* (by suitable connecting means). Each first leg portion terminates in a lower distal end, to which a respective caster-type roller 228*a* and 228*b* is preferably rotatably mounted. A generally C-shaped loop 227*a* or 227*b* is rigidly mounted onto each first leg portion (by welding or other suitable means) to serve as a towel holder and/or a handle for maneuvering the stand across the floor.

The intermediate frame members 210*a* and 210*b* may be described as generally S-shaped members having respective intermediate portions that extend horizontally and are interconnected to one another by bolts 216 or other suitable means. Each frame member 210*a* and 210 has a respective downwardly extending leg, on which a respective caster-type roller 218*a* or 218*b* is rotatably mounted. Each frame member 210*a* and 210*b* also has a respective upwardly extending post or shaft, on which a respective dumbbell support 220*a* or 220*b* is rotatably mounted.

Figure 7:
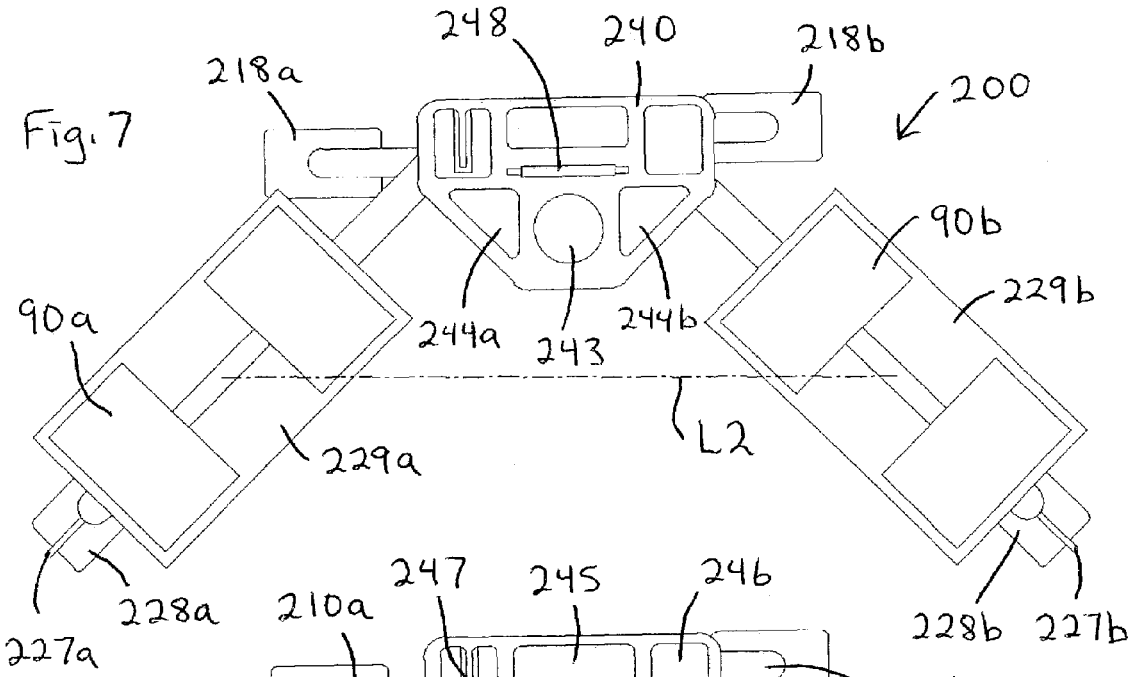
FIG. 7 is a top view of a second exercise system constructed according to the principles of the present invention, and arranged in a first configuration.
Figure 8:
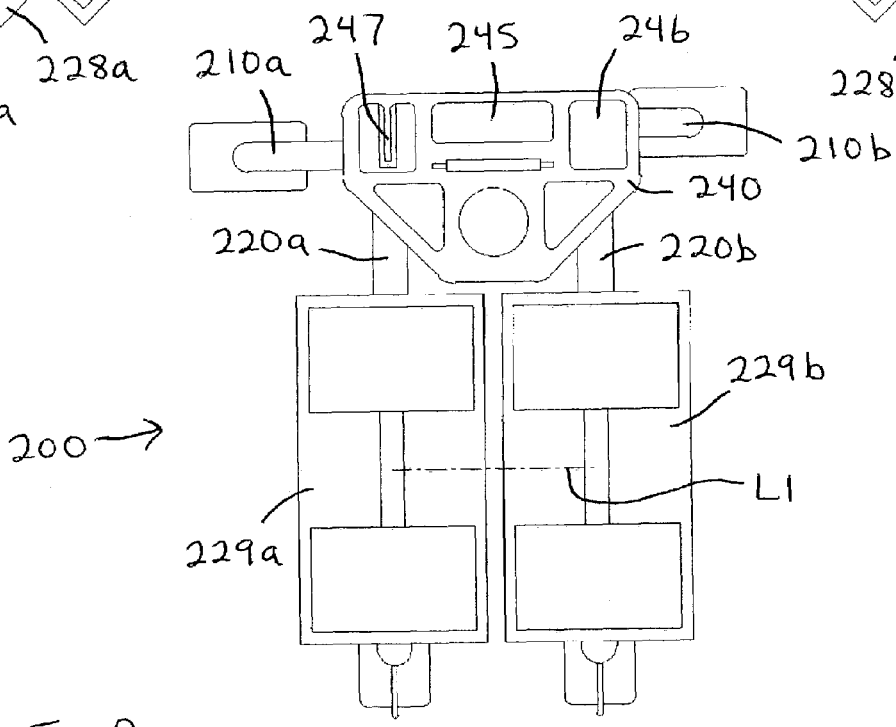
FIG. 8 is a top view of the exercise system of FIG. 7 arranged in a second configuration.
Figure 10:
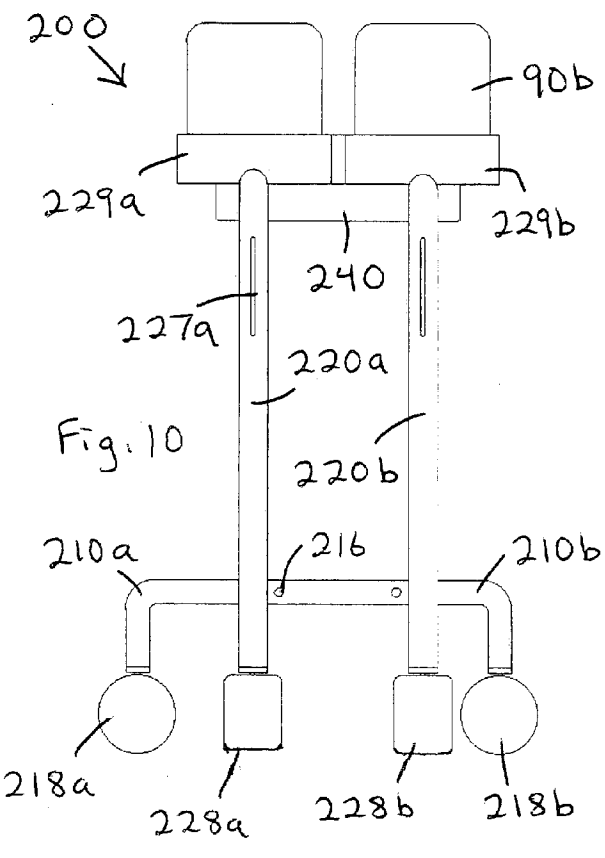
FIG. 10 is a front view of the exercise system of FIG. 8.
Figure 9:
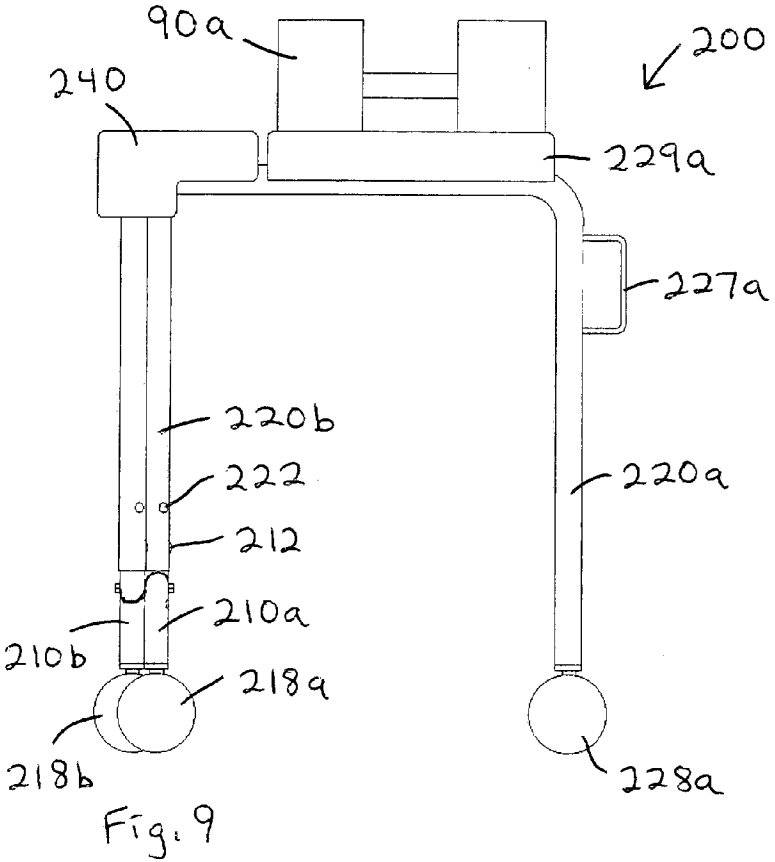
FIG. 9 is a side view of the exercise system of FIG. 8.
Figure 11:
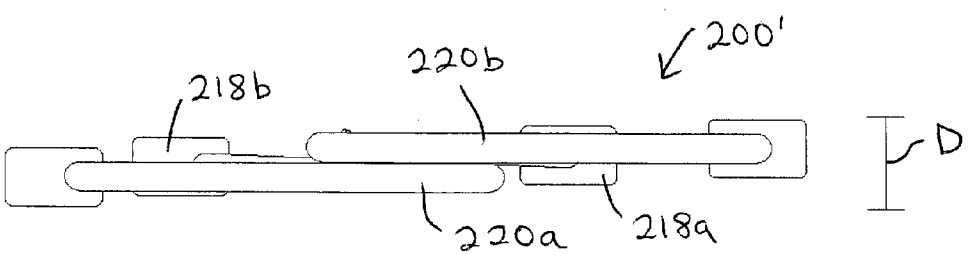
FIG. 11 is a top view of a stand portion of the exercise system of FIGS. 7–10 arranged in a third configuration.

Snap buttons 212 are disposed inside the post portions of the frame members 210*a* and 210*b*, and they project through holes in respective frame members 210*a* and 210*b* and aligned holes 222 in respective dumbbell supports 220*a* and 220*b*. The holes are arranged to latch the stand in either of the configurations shown in FIGS. 7 and 8. In this regard, FIG. 8 shows a first, relatively compact configuration, wherein the dumbbell supports 220*a* and 220*b* extend parallel to one another, and the dumbbells 90*a* and 90*b* are adjacent one another (with a distance L1 defined between their handles or geometric centers). FIG. 7 shows a second configuration, wherein the dumbbell supports 220*a* and 220*b* cooperate to define a V-shaped arrangement, and a person may stand directly in front of an edge of the tray 240 and between the dumbbells 90*a* and 90*b* (because a relatively greater distance L2 is now defined between their handles or geometric centers). Generally speaking, the dumbbell supports 220*a* and 220*b* are configured and arranged so that the distance L1 is about six inches, and the distance L2 is about twenty inches (and the associated distance between the rollers 228*a* and 228*b* is even greater). FIG. 11 shows how the dumbbell supports 220*a* and 220*b* may be rotated to a relatively compact configuration relative to the intermediate frame members 110*a* and 110*b* (for shipping and/or long-term storage).

FIGS. 7–10 show the stand with a tray 240 mounted on the dumbbell supports 220*a* and 220*b* to provide upwardly opening compartments for storage of personal items. For example, the depicted tray 240 provides a cylindrical compartment 243 to support a beverage container; shallow triangular compartments 244*a* and 244*b* to store jewelry, keys, lip balm, or other suitably sized items; a relatively deeper compartment 245 to store a hand-held remote control device, a folded magazine, or other suitably sized items; a compartment 246 to store jewelry, keys, lip balm, or other suitably sized items; a compartment with a clip 247 to store paper items, jewelry, or other suitable sized items, and a slot 248 to store a spiral bound note pad with a pencil inserted through the spiral binder. On the depicted embodiment 200, the tray 240 is placed on top of the dumbbell supports 220*a* and 220*b*, and U-shaped collars (not shown) are disposed about the vertical portions of respective supports 220*a* and 220*b* and connected to respective inwardly facing portions of the tray 240 by screws or other suitable means.

A third exercise system constructed according to the principles of the present invention is designated as 300 in FIGS. 12–15. The system 300 may similarly be described in terms of the same pair of known selectorized dumbbells 90*a* and 90*b* disposed on yet another novel dumbbell stand.

A functionally identical weight base or cradle 329*a* and 329*b* is provided for each dumbbell 90*a* and 90*b* to support the weight plates in proper alignment when not in use. The cradles 329*a* and 329*b* are mounted on respective first and second dumbbell supports 320*a* and 320*b* by bolts (not shown) or other suitable means. The bottom of each cradle 329*a* and 329*b* is preferably provided with a partially cylindrical channel that registers with a respective dumbbell support 320*a* or 320*b*.

Each dumbbell support 320*a* and 320*b* may alternatively be described as a generally J-shaped member having a vertical leg portion that is supported by an underlying floor surface, a horizontal beam portion that supports a respective dumbbell 90*a* or 90*b*, and a shorter vertical portion 324*a* or 324*b* that is rotatably connected to a respective side of an intermediate frame member 310 and/or tray 340 (by suitable connecting means). Each leg portion terminates in a lower distal end, to which a respective caster-type roller 328*a* and 328*b* is preferably rotatably mounted. Each shorter vertical portion 324*a* and 324*b* is inserted into a respective hole in the tray 340.

In addition to providing support for the dumbbell supports 320*a* and 320*b*, the tray 340 is preferably configured to provide both a means for latching the dumbbell supports 320*a* and 320*b* in desired positions (as further discussed in the next paragraph), and upwardly opening compartments for storage of personal items. For example, the depicted tray 340 provides a first cylindrical compartment 343 to support a beverage container; and a second cylindrical compartment 345 to receive jewelry, keys, lip balm, or other suitably sized items. On the depicted embodiment 300, the tray 340 slides onto an upper portion of an intermediate frame member 310 and may be secured in place by bolts (not shown) or other suitable means.

Figure 12:
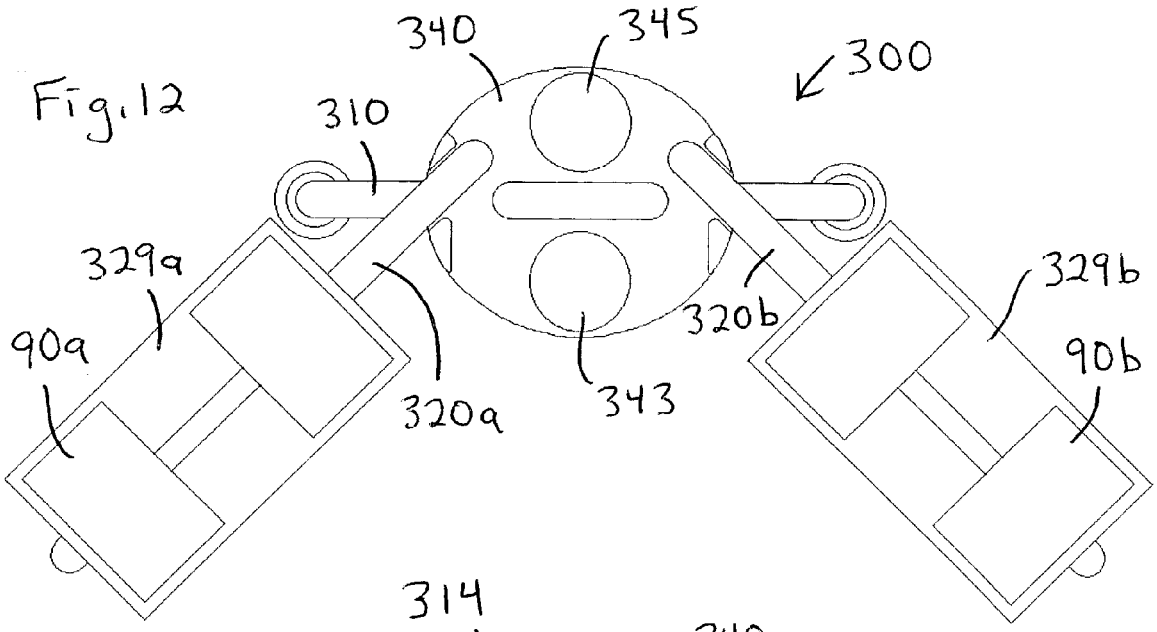
FIG. 12 is a top view of a third exercise system constructed according to the principles of the present invention, and arranged in a first configuration.
Figure 13:
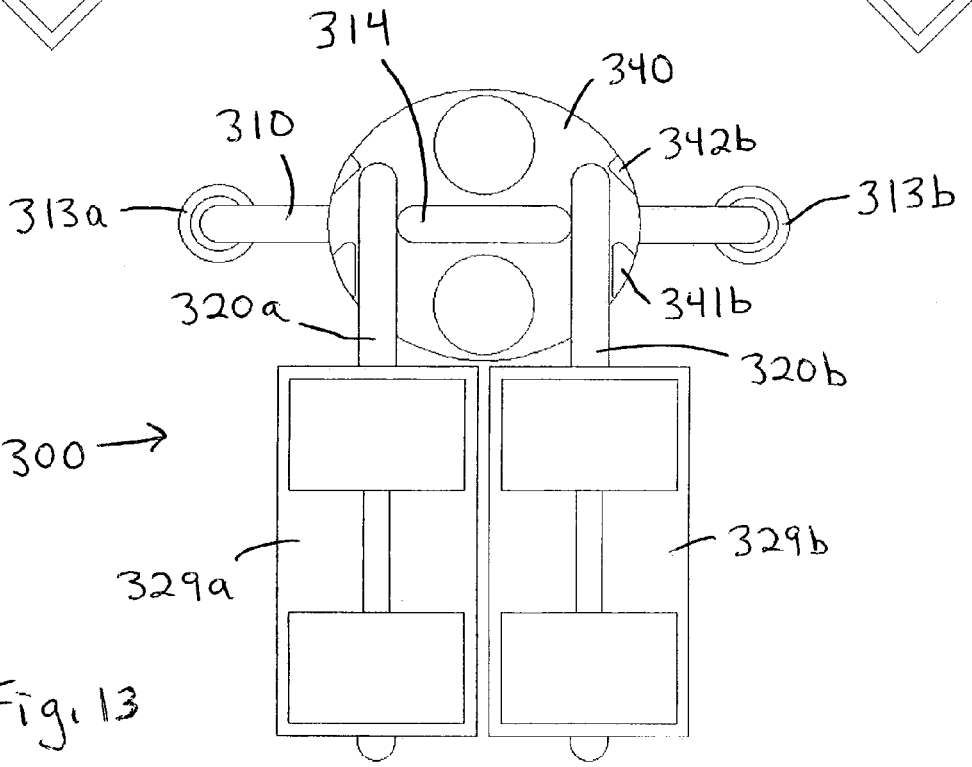
FIG. 13 is a top view of the exercise system of FIG. 12 arranged in a second configuration.
Figure 15:
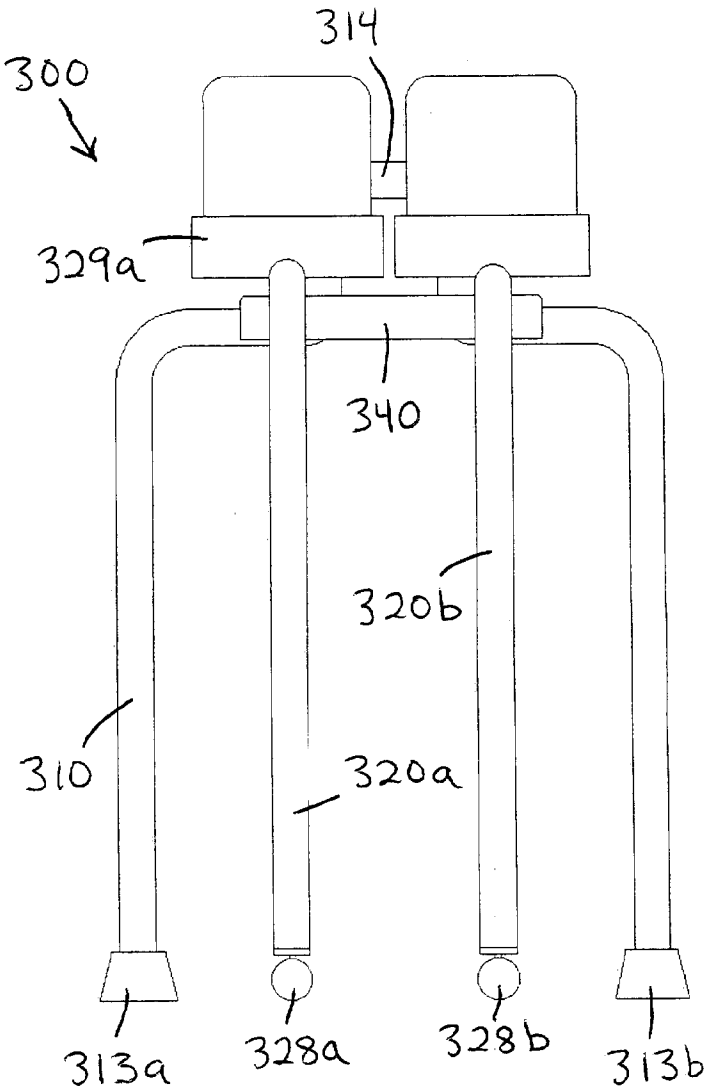
FIG. 15 is a front view of the exercise system of FIG. 13.
Figure 14:
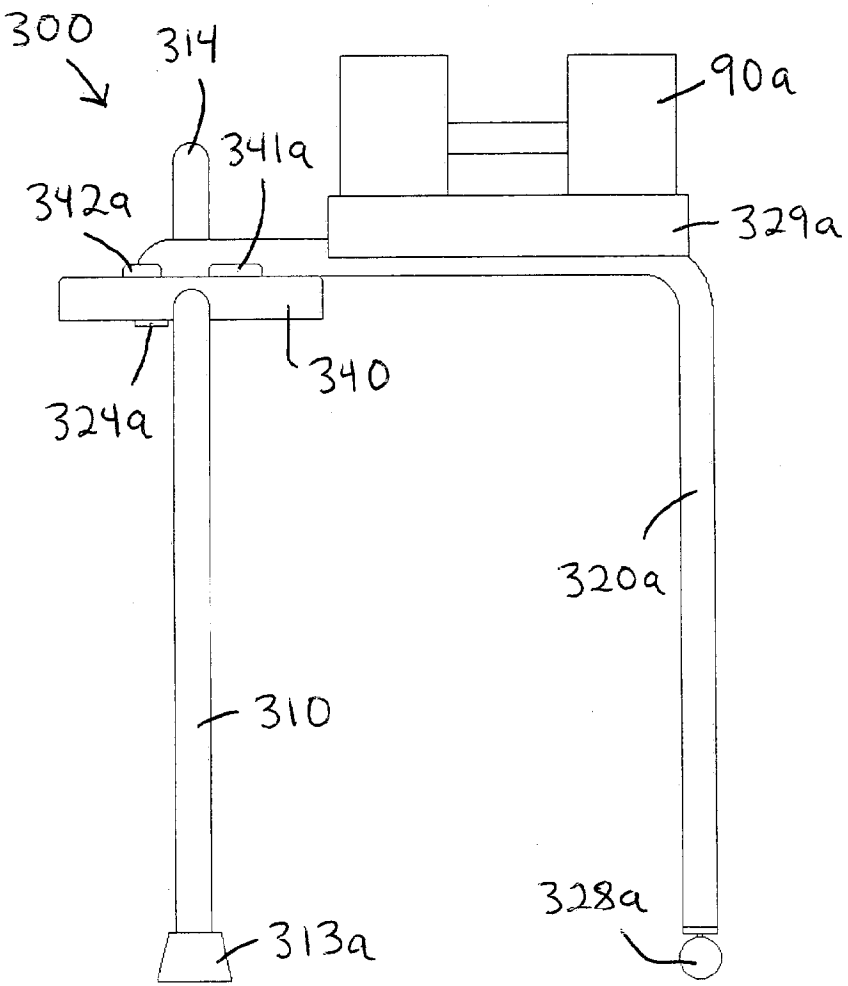
FIG. 14 is a side view of the exercise system of FIG. 13.

With regard to the latching means, the tray 340 includes upwardly extending nubs 341*a* and 341*b* and upwardly extending stops 342*a* and 342*b* on respective sides of the tray 340. In FIG. 12, each dumbbell support 320*a* and 320*b* is disposed between a respective nub 341*a* or 341*b* and a respective stop 342*a* or 342*b*. In FIG. 13, each dumbbell support 320*a* and 320*b* is disposed between a respective nub 341*a* or 341*b* and a respective portion of the intermediate frame member 310. On one embodiment, the nubs 341*a* and 341*b* may be formed as leaf springs that resiliently deflect downward to accommodate movement of the dumbbell supports 320*a* and 320*b* between these two configurations, and on another embodiment, they are rigid features that require the dumbbell supports 320*a* and 320*b* to be lifted slightly to accommodate reconfiguration.

The intermediate frame member 310 may be described as an inverted, generally U-shaped member having first and second downwardly extending legs, and an upwardly extending intermediate portion 314 that is also an inverted, generally U-shaped member. Plastic feet 313*a* and 313*b* are mounted on the lower distal ends of respective legs (although caster-type rollers could be used in the alternative). The intermediate portion 314 inserts through a central slot in the tray 340, and may serve as a towel holder and/or as a handle for maneuvering the stand across the floor. Extending from opposite ends of the intermediate portion 314, the symmetrical horizontal portions of the frame member 310 define shoulders that underlie the tray 340, and provide support for both the tray 340 and the dumbbell supports 320*a* and 320*b*.

As suggested by FIGS. 12 and 13, the stand may be rearranged or transformed into multiple configurations. FIG. 13 shows a first, relatively compact configuration, wherein the dumbbell supports 320*a* and 320*b* extend parallel to one another, and the dumbbells 90*a* and 90*b* are adjacent one another (with a distance of about six inches defined between their geometric centers). FIG. 12 shows a second configuration, wherein the dumbbell supports 320*a* and 320*b* cooperate to define a V-shaped arrangement, and a person may stand directly in front of an edge of the tray 340 and between the dumbbells 90*a* and 90*b* (because a relatively greater distance of about twenty inches is now defined between their geometric centers). In addition, the stand may be readily broken down into pieces for shipping and/or long-term storage by removing the dumbbell supports 320*a* and 320*b* from the tray 340, and removing the tray 340 from the frame member 310.

The foregoing description and accompanying drawings are directed toward specific embodiments with the understanding that various features may be mixed, matched, altered, and/or eliminated without departing from the scope of the present invention. In construing the nature and scope of the present invention, no special significance should automatically be attributed to the fact that some features and/or advantages are discussed and/or shown in greater detail than others, or included on some embodiments but not others. For example, various accessory trays may be mounted on other types of dumbbell stands, and/or mounted in different ways on the foregoing embodiments. In this regard, a tray may be configured and arranged for mounting on one of the dumbbell supports rather than, or in addition to, a tray mounted on an intermediate frame member, and/or one or more such trays may be mounted on respective dumbbell supports that are not even associated with an intermediate frame member.

Among other things, multiple embodiments have been shown and described to help demonstrate that the present invention may be implemented in various ways. For example, the depicted dumbbell supports may be movable subject only to frictional resistance, gravitational resistance (to the extent that they must first be lifted before pivoting), and/or resilient resistance (provided by leaf springs on a tray). In addition or the alternative, the dumbbell supports may be locked against movement by snap buttons interconnected between the dumbbell supports and the intermediate frame member(s); spring detent pins inserted though aligned holes in the dumbbell supports and the intermediate frame member(s); and/or caster-type rollers of the type that may be selectively locked against rotation. Recognizing that many variations are contemplated, and that this disclosure will enable persons skilled in the art to realize such variations and/or derive additional embodiments of the present invention, the scope of the present invention should be limited only to the extent of the following claims.

What is claimed is:

1. A dumbbell stand for supporting a pair of exercise dumbbells above a floor surface, comprising:

a first dumbbell support and a second dumbbell support, wherein each said dumbbell support has a leg portion configured and arranged to engage the floor surface, and a beam portion configured and arranged to support a respective dumbbell; and arranging means, interconnected between the first dumbbell support and the second dumbbell support, for arranging the first dumbbell support and the second dumbbell support in more than one configuration, including a first configuration, wherein a first horizontally measured distance is defined between each said leg portion, and a first angle is defined between each said beam portion, and a second configuration, wherein a second, relatively greater horizontally measured distance is defined between each said leg portion, and a second angle is defined between each said beam portion.

2. The dumbbell stand of claim 1, wherein a respective floor engaging roller is rotatably mounted on a lower end of each said leg portion.

3. The dumbbell stand of claim 1, wherein the means includes a U-shaped support frame, and each said beam portion is pivotally connected to a respective leg of the U-shaped support frame.

4. The dumbbell stand of claim 1, wherein the first dumbbell support and the second dumbbell support have opposing counterparts that extend parallel to one another when viewed from above in the first configuration, and that extend perpendicular to one another when viewed from above in the second configuration.

5. The dumbbell stand of claim 1, wherein each said beam portion defines a V-shaped configuration when viewed from above.

6. The dumbbell stand of claim 1, wherein the second distance is sufficient to accommodates a person standing on the floor surface between the beam portion of the first dumbbell support and the beam portion of the second dumbbell support.

7. The dumbbell stand of claim 1, wherein each said dumbbell support includes a respective weight cradle having a plurality of individual, upwardly opening weight compartments, and further comprising a respective selectorized dumbbell disposed on each said cradle.

8. The dumbbell stand of claim 1, wherein the arranging means includes at least one intermediate frame member interconnected between the first dumbbell support and the second dumbbell support, and further comprising an accessory tray mounted on the at least one intermediate frame member.

9. The dumbbell stand of claim 1, further comprising an accessory tray operatively connected to at least one of the first dumbbell support and the second dumbbell support, wherein the accessory tray provides a first upwardly opening compartment of a first size and shape, and a second upwardly opening compartment of a discrete, second size and shape.

10. The dumbbell stand of claim 1, further comprising latching means for latching each said dumbbell support in a desired said configuration.

11. A dumbbell stand for supporting a pair of exercise dumbbells above a floor surface, comprising:

a first dumbbell support configured and arranged to support a first dumbbell;

a second dumbbell support configured and arranged to support a second dumbbell;

a base configured and arranged to engage the floor surface;

an accessory tray mounted on the base, wherein the tray defines at least two upwardly opening compartments having discrete sizes and shapes; and connecting means for connecting each said dumbbell support to the base.

12. The dumbbell stand of claim 11, wherein the stand is supported exclusively on rollers configured and arranged to engage an underlying floor surface.

13. The dumbbell stand of claim 11, wherein at least one roller is rotatably mounted on a lower end of the first dumbbell support, and at least one roller is rotatably mounted on a lower end of the second dumbbell support.

14. The dumbbell stand of claim 11, wherein one of the upwardly opening compartments is sized and configured to support a cylindrical beverage container.

15. The dumbbell stand of claim 11, wherein each said dumbbell support defines a V-shaped configuration when viewed from above.

16. The dumbbell stand of claim 11, wherein the connecting means includes a sleeve rigidly connected to the first dumbbell support and pivotally connected to a first shaft on the base, and another sleeve rigidly connected to the second dumbbell support and pivotally connected to a second shaft on the base.

17. The dumbbell stand of claim 16, wherein a first roller is mounted on a lower end of the first dumbbell support for movement across the floor surface in an arcuate path about the first shaft, and a second roller is mounted on a lower end of the second dumbbell support for movement across the floor surface in an arcuate path about the second shaft.

18. The dumbbell stand of claim 11, wherein each said dumbbell support includes a respective weight cradle.

19. The dumbbell stand of claim 18, further comprising a respective selectorized dumbbell stored on each said weight cradle.

20. The dumbbell stand of claim 11, further comprising latching means for latching each said dumbbell support in place relative to the base to maintain a fixed distance between the opposing counterparts.

21. A dumbbell stand for supporting a pair of exercise dumbbells above a floor surface, comprising:

a first dumbbell support having a leg portion configured and arranged to engage the floor surface, and a beam portion configured and arranged to support a first dumbbell;

a second dumbbell support having a leg portion configured and arranged to engage the floor surface, and a beam portion configured and arranged to support a second dumbbell;

a base configured and arranged to engage the floor surface;

a first sleeve rigidly connected to the first dumbbell support and pivotally connected to a first vertical shaft on the base; and a second sleeve rigidly connected to the second dumbbell support and pivotally connected to a second vertical shaft on the base.

22. The dumbbell stand of claim 21, wherein the stand is supported exclusively on rollers that are configured and arranged to engage the floor surface.

23. The dumbbell stand of claim 21, wherein a respective roller is rotatably mounted on a lower end of each said leg portion.

24. The dumbbell stand of claim 21, wherein the first dumbbell support and the second dumbbell support pivot relative to the base to alternatively define a first operative configuration wherein opposing counterparts on each said dumbbell support extend parallel to one another when viewed from above and define a first distance therebetween, and a second configuration wherein the opposing counterparts extend perpendicular to one another when viewed from above and define a relatively greater, second distance therebetween.

25. The dumbbell stand of claim 21, wherein each said dumbbell support defines a V-shaped configuration when viewed from above.

26. The dumbbell stand of claim 21, wherein a first roller is mounted on a lower end of the first dumbbell support for movement across the floor surface in an arcuate path about the first shaft, and a second roller is mounted on a lower end of the second dumbbell support for movement across the floor surface in an arcuate path about the second shaft.

27. The dumbbell stand of claim 21, wherein each said dumbbell support includes a respective weight cradle.

28. The dumbbell stand of claim 27, further comprising a respective selectorized dumbbell stored on each said weight cradle.

29. The dumbbell stand of claim 21, further comprising means for latching each said dumbbell support in place relative to the base.

30. A dumbbell stand for supporting a pair of exercise dumbbells above a floor surface, comprising:

a base having opposite end portions configured and arranged to engage the floor surface;

a first dumbbell support having a leg portion configured and arranged to engage the floor surface, and a beam portion movably connected to the base and configured and arranged to support a first dumbbell; and a second dumbbell support having a leg portion configured and arranged to engage the floor surface, and a beam portion movably connected to the base and configured and arranged to support a second dumbbell.

31. The dumbbell stand of claim 30, wherein a respective, floor engaging roller is mounted on a lower end of each said leg portion.

32. The dumbbell stand of claim 31, wherein a respective, floor engaging roller is mounted on each of said end portions.

33. The dumbbell stand of claim 30, further comprising an accessory tray mounted on the base in horizontal alignment with each said beam portion.

34. The dumbbell stand of claim 33, wherein each said beam portion is pivotally connected to a respective vertical shaft on the base, thereby defining a variable width space therebetween.

35. The dumbbell stand of claim 34, wherein each said beam portion is configured and arranged to be directly in front of the tray when the space is minimal.

36. The dumbbell of claim 33, wherein the tray defines at least one upwardly opening compartment that is sized and configured to support a cylindrical beverage container, and at least one upwardly opening compartment that is a different size and shape.

37. The dumbbell stand of claim 30, wherein each said dumbbell support is configured and arranged to pivot about a respective vertical shaft on the base.

38. The dumbbell stand of claim 30, wherein each said beam portion cooperates with a respective said leg portion to defines an inverted L-shaped dumbbell support.

39. The dumbbell stand of claim 30, wherein each said beam portion defines a V-shaped configuration when viewed from above.

* * * * *